US008151423B2

(12) United States Patent
Dear et al.

(10) Patent No.: US 8,151,423 B2
(45) Date of Patent: Apr. 10, 2012

(54) FASTENER INSTALLATION TOOL

(75) Inventors: Aiden Dear, Hitchin (GB); Angraj Kumar Seewraj, Welwyn (GB); Simon Andrew, Hemel Hempstead (GB)

(73) Assignee: Avdel UK Limited, Welwyn Garden City, Hertfordshire (GB)

( * ) Notice: Subject to any disclaimer, the term of this patent is extended or adjusted under 35 U.S.C. 154(b) by 0 days.

(21) Appl. No.: 12/809,908

(22) PCT Filed: Oct. 23, 2008

(86) PCT No.: PCT/GB2008/050981

§ 371 (c)(1), (2), (4) Date: Aug. 30, 2010

(87) PCT Pub. No.: WO2009/077771

PCT Pub. Date: Jun. 25, 2009

(65) Prior Publication Data

US 2010/0314430 A1 Dec. 16, 2010

(30) Foreign Application Priority Data

Dec. 19, 2007 (GB) ..... 0724657.2

(51) Int. Cl.
*B21J 15/22* (2006.01)
*B21D 9/05* (2006.01)

(52) U.S. Cl. ..... 29/243.523; 29/243.525; 72/391.4

(58) Field of Classification Search ..... 29/243.523, 29/243.521, 243.525; 72/391.4
See application file for complete search history.

(56) References Cited

U.S. PATENT DOCUMENTS

| | | | | | |
|---|---|---|---|---|---|
| 4,598,571 | A * | 7/1986 | Oefinger | 29/243.525 |
| 4,887,450 | A * | 12/1989 | Gast et al. | 29/243.523 |
| 4,888,974 | A * | 12/1989 | Mandell | 29/243.523 |
| 5,490,311 | A * | 2/1996 | Rosier | 29/243.523 |
| 5,697,137 | A * | 12/1997 | Frearson et al. | 29/243.525 |
| 5,806,160 | A * | 9/1998 | Frearson et al. | 29/243.523 |
| 6,276,037 | B1 * | 8/2001 | Solfronk | 29/243.525 |
| 6,883,216 | B2 * | 4/2005 | Gilbert et al. | 29/243.523 |
| 7,866,018 | B2 * | 1/2011 | Dear | 29/243.523 |

FOREIGN PATENT DOCUMENTS

| | | |
|---|---|---|
| DE | 20 2004 012 268 U1 | 12/2005 |
| EP | 1 300 205 A2 | 4/2003 |
| GB | 2 301 547 A | 12/1996 |
| GB | 2 372 475 A | 8/2002 |
| GB | 2 394 686 A | 5/2004 |

* cited by examiner

*Primary Examiner* — David Jones
(74) *Attorney, Agent, or Firm* — Hahn, Loeser & Parks LLP; Arland T. Stein

(57) ABSTRACT

A fastener installation tool for installing breakstem fasteners, wherein a part of the fastener is broken off during installation and ejected into a collector bottle, provided with a safety disabling means, comprising a valve located in series with and between the tool trigger and main operating valve, wherein removal of the collector bottle causes the valve to close to prevent operation of the main operating valve, thereby to prevent use of the tool with the connector bottle disconnected.

17 Claims, 9 Drawing Sheets

FASTENER INSTALLATION TOOL

This application is a National Phase filing regarding International Application No. PCT/GB2008/050981, filed Oct. 23, 2008. International Application No. PCT/GB2008/050981 relies upon British Application No. 0724657.2, filed Dec. 19, 2007 for priority.

BACKGROUND AND SUMMARY

This invention relates to a safety device for a fastener installation tool provided with collection means for collecting parts of fasteners which are broken off during installation of the fastener.

Fastener installation tools including collection means are known, for example as described in GB 2372475B. The tools may be provided with a vacuum extraction facility whereby broken-off parts, i.e. stems, are ejected into the collection means during normal operation of the tool. The collection means may be removable to allow the tool operator to empty the broken-off parts, i.e. stems, from the collection means. Installation tools having removable collection means may include a safety shutter, which is actuated when the collection means is removed from the tool. The safety shutter when actuated provides a fixed barrier normal to the path of the stems, and prevents stems from being ejected from the tool without the collection means being in place, which could cause injury to the operator.

However, a problem with the use of such a safety shutter is that the stems may jam in the installation tool. Continued use of the installation tool is possible even when the collection means has been removed, with the safety shutter acting to keep the broken-off fastener parts within the tool. Such continued use causes damage to the safety shutter, and causes stems to build up within the piston, necessitating partial dismantling of the tool to clear the build up.

The applicant's co-pending application patent application GB 0702792.3 discloses an installation tool having a shutter urged closed by resilient means. If the tool is operated with the collector bottle disconnected, broken-off fastener stems collect within the tool. Once a sufficient number of stems have collected within the tool, the resilient means are overcome to allow the shutter to open and allows stems to be ejected from the tool in a controlled manner.

It is an aim of the present invention to provide a simple means for preventing broken-off fastener stems from being ejected from the rear of an installation tool whilst the collector bottle is not attached, and to prevent the jamming of broken off fastener stems within the tool.

Accordingly, the present invention provides, in one aspect, a fastener installation tool for installing fasteners of the type in which a part of the fastener is broken off during the installation process, which fastener installation tool is provided with a trigger, wherein depression of the trigger causes actuation of a main operating valve thereby to install a fastener, and collection means for collecting broken-off fastener parts during operation of the tool, the collection means being removably connected to the tool; the tool being further provided with disabling means which are actuable to prevent operation of the main operating valve thereby to prevent use of the tool to install a fastener, the arrangement being such that when the collection means is disconnected from the tool, the disabling means are actuated.

The present invention provides a fastener installation tool wherein the tool is disabled when the collector bottle is unattached. As the tool cannot be used when the collector bottle is not attached, the risk of injury or damage caused by broken off stems being ejected from the tool is prevented. Furthermore, broken-off stems cannot build up within the tool, thereby preventing the potential jamming of stems necessitating dismantling of the tool.

The disabling means preferably acts to disable the tool by preventing operation of the tool trigger. The disabling means may additionally act to disable the vacuum extraction facility in addition to the tool trigger and main operating valve.

The disabling means may comprise a valve, which may be connected in series with the tool trigger and the main operating valve. Alternatively, the valve could be positioned between the main operating valve and the air inlet through which compressed air is supplied to the tool.

The valve may be maintained in an open position by a positive pressure signal, wherein removal of the pressure signal causes the valve to change to a closed position. In an alternative embodiment, the valve could be maintained in a closed position by a positive pressure signal, wherein removal of the pressure signal causes the valve to change to an open position.

In an alternative embodiment, the disabling means may include a chamber which is supplied with air at first rate when the collection means is connected to the tool, wherein depression of the tool trigger causes evacuation of the chamber thereby causing actuation of the main operating valve, and wherein the chamber is supplied with air at a second rate, the second rate being higher than the first, such that when the collection means is disconnected, the air supplied to the chamber is greater than that which can be evacuated on depression of the tool trigger, thereby preventing actuation of the main operating valve. The disabling means of this embodiment may further include at least two valves which are open when the collection means is disconnected from the tool, and closed when the collection means is connected to the tool.

The chamber is preferably positioned between the tool trigger and the main operating valve.

BRIEF DESCRIPTION OF THE DRAWINGS

The invention will now be described by way of example only with reference to the accompanying figures in which.

DETAILED DESCRIPTION OF THE DRAWINGS

Figure 1:
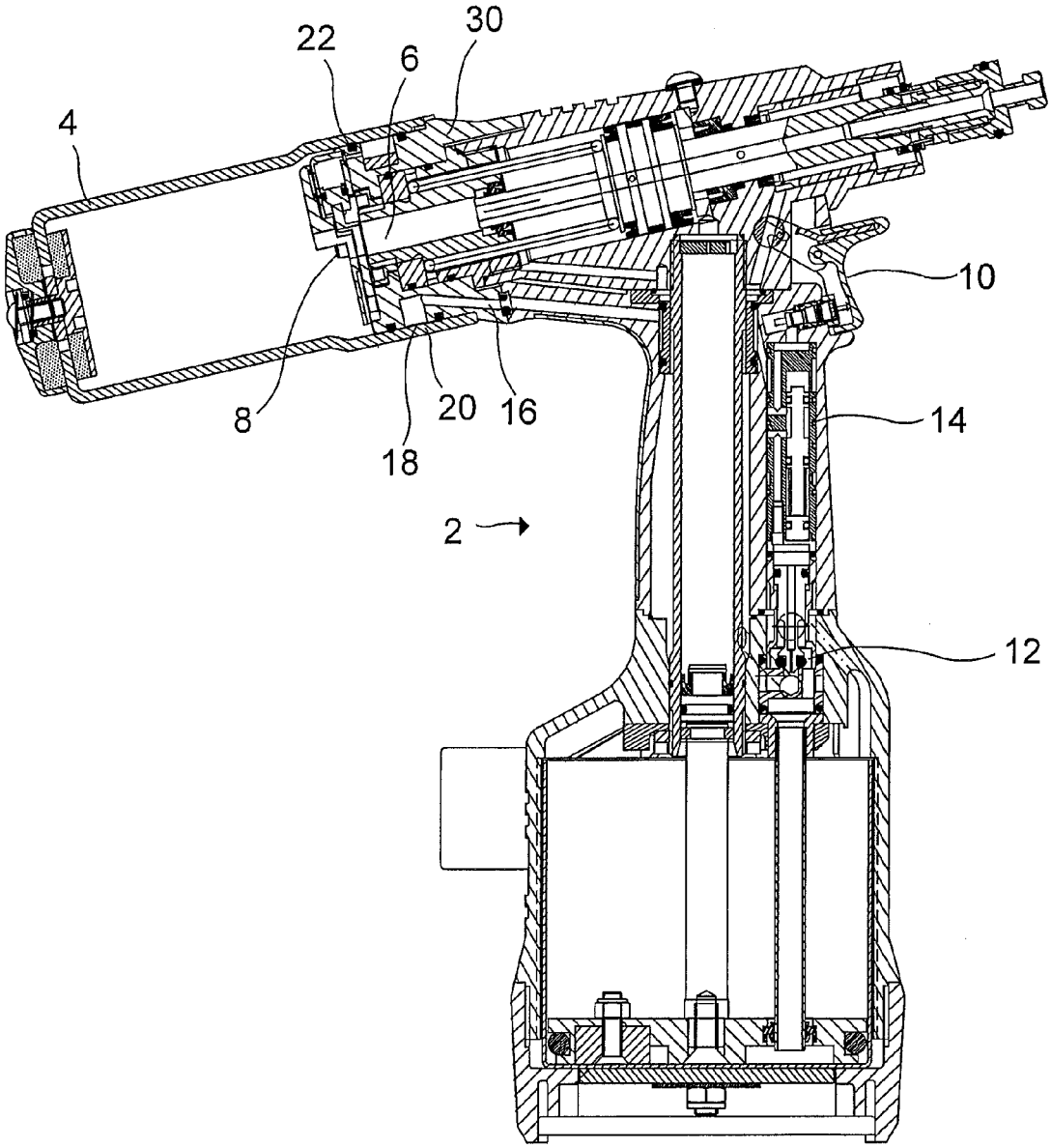
FIG. 1 is a cross-sectional view of a fastener installation tool according to the present invention with the collector bottle connected.

Referring to FIG. 1, a tool 2 is provided with a collection means comprising a collector bottle 4 connected to the rear of the tool. A through bore 6 having an exit 8 is provided to allow ejection of broken-off fastener stems (not shown). The tool 2 is provided with a pneumatic tool trigger 10 and a pneumatic main operating valve 12. A disabling valve 14 is provided in series between the tool trigger 10 and the main operating valve 12.

During normal use of the tool 2, the collector bottle 4 is connected to an adaptor 30 rear of the tool 2, as illustrated in FIG. 1. Compressed air is supplied to the tool, and depression of the tool trigger 10 causes the compressed air to actuate the main operating valve 12, thereby causing a fastener to be installed. The broken-off fastener stem is ejected through the exit 8 of the through bore 6, and into the collector bottle 4.

Figure 2:
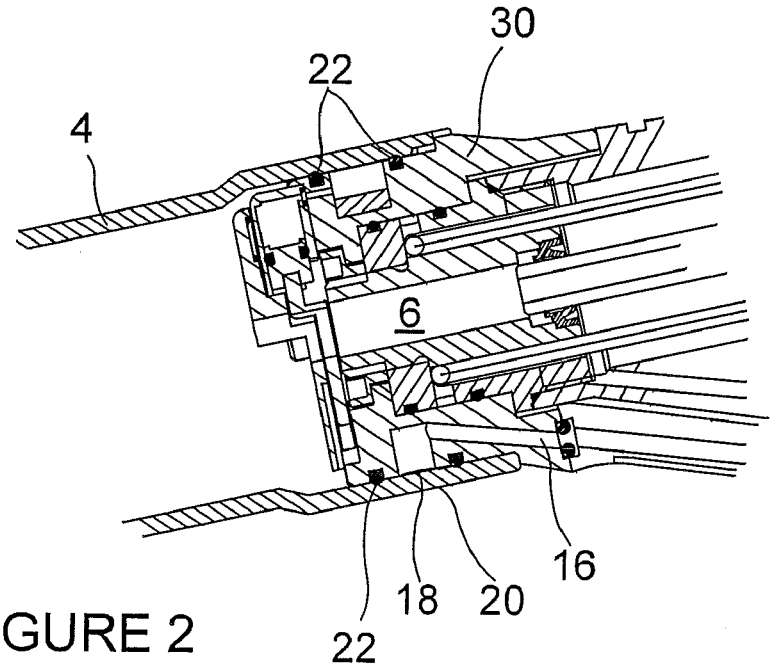
FIGS. 2 and 3 are a partial cross-sectional views of the fastener installation tool of FIG. 1.
Figure 3:
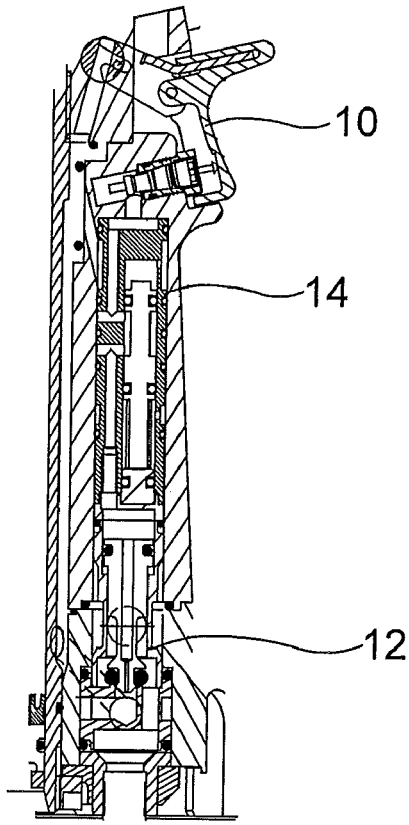

When the collector bottle 4 is connected to the rear of the tool 2, a positive pressure signal is provided to disabling valve 14, maintaining the disabling valve 14 in an open position, as illustrated in FIGS. 1 and 3, wherein the tool trigger 10 and main operating valve 12 are enabled. The tool 2 is provided with a channel 16 and aperture 18 connected to the compressed air supply. When the collector bottle 4 is connected, a wall 20 of the collector bottle 4 covers the aperture 18 and prevents air from escaping from the tool 2, as illustrated in FIG. 1 and in detail in FIG. 2. Seals 22 are provided to prevent air leaking between the tool and the collector bottle wall 20 from aperture 18 whilst the collector bottle 4 is connected.

Figure 4:
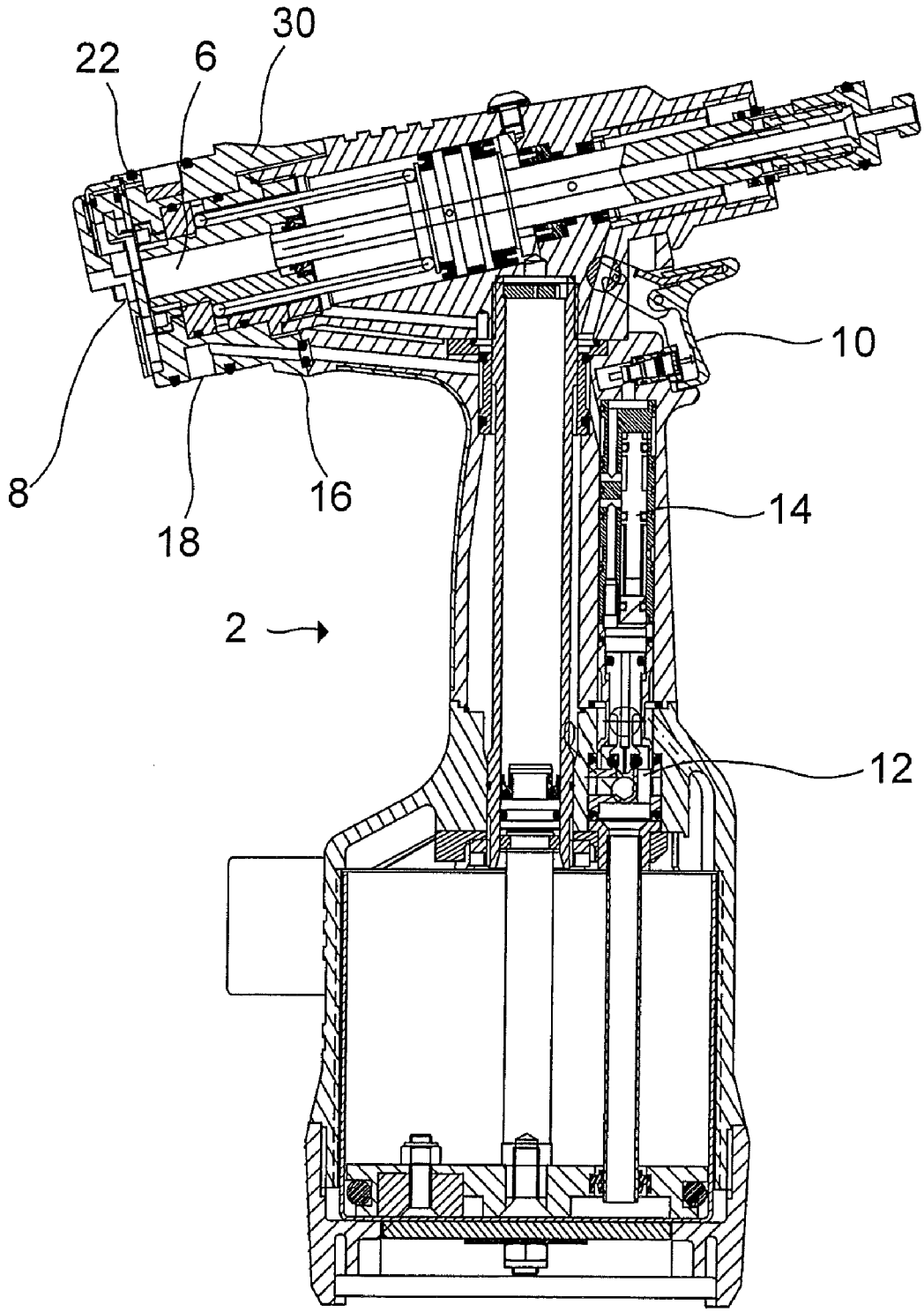
FIG. 4 is a cross-sectional view of the fastener installation tool of FIG. 1 with the collector bottle disconnected.
Figure 5:
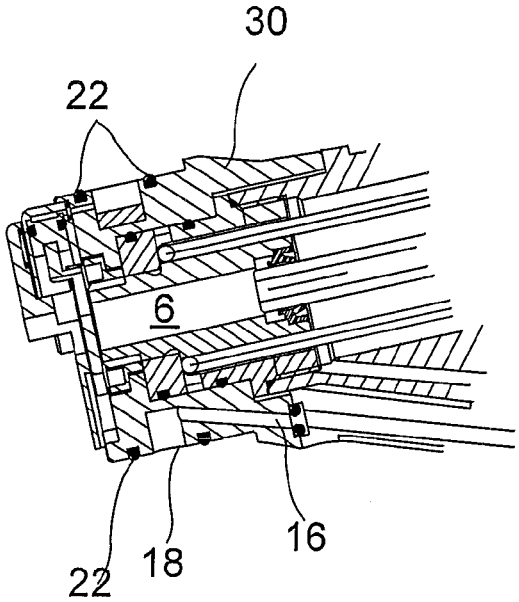
FIGS. 5 and 6 are a partial cross-sectional views of the fastener installation tool of FIG. 4.
Figure 6:
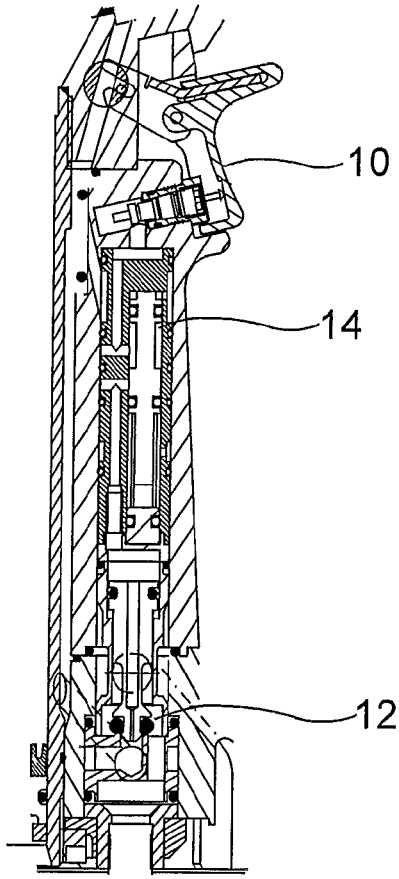

As illustrated in detail in FIG. 5, when the collector bottle 4 is disconnected from the rear of the tool 2, the compressed air supply is able to vent through the aperture 18. Consequently, the positive pressure signal to the disabling valve 14 is removed, and the disabling valve 14 is thereby caused, by action of a spring return, to change to a closed position, as illustrated in FIGS. 4 and 6. When the disabling valve 14 is in the closed position, the tool trigger 10 and main operating valve 12 are disabled. The tool 2 therefore cannot be used to install a fastener whilst the collector bottle 4 is disconnected.

In the first embodiment, as illustrated in FIGS. 1 to 6, the disabling means is arranged to actuate in response to a loss of pressure signal. In the alternative embodiment of FIGS. 7 to 10, the disabling means is caused to actuate to prevent operation of the tool when a signal is received. The same numerals have been used as for the first embodiment where appropriate.

Figure 7:
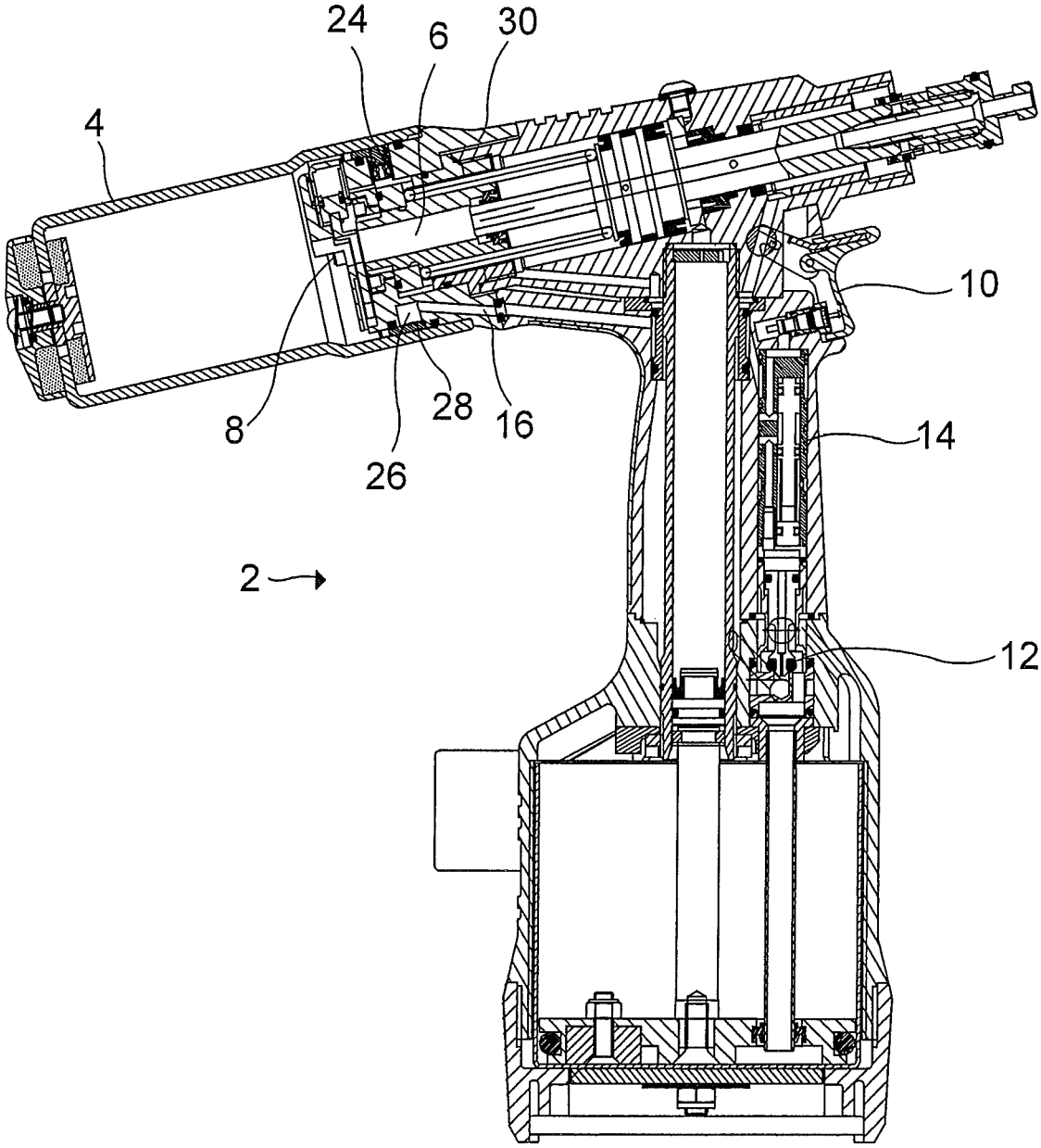
FIG. 7 is a cross-sectional views of an alternative embodiment of a fastener installation tool in accordance with the present invention, with the collector bottle connected.
Figure 8:
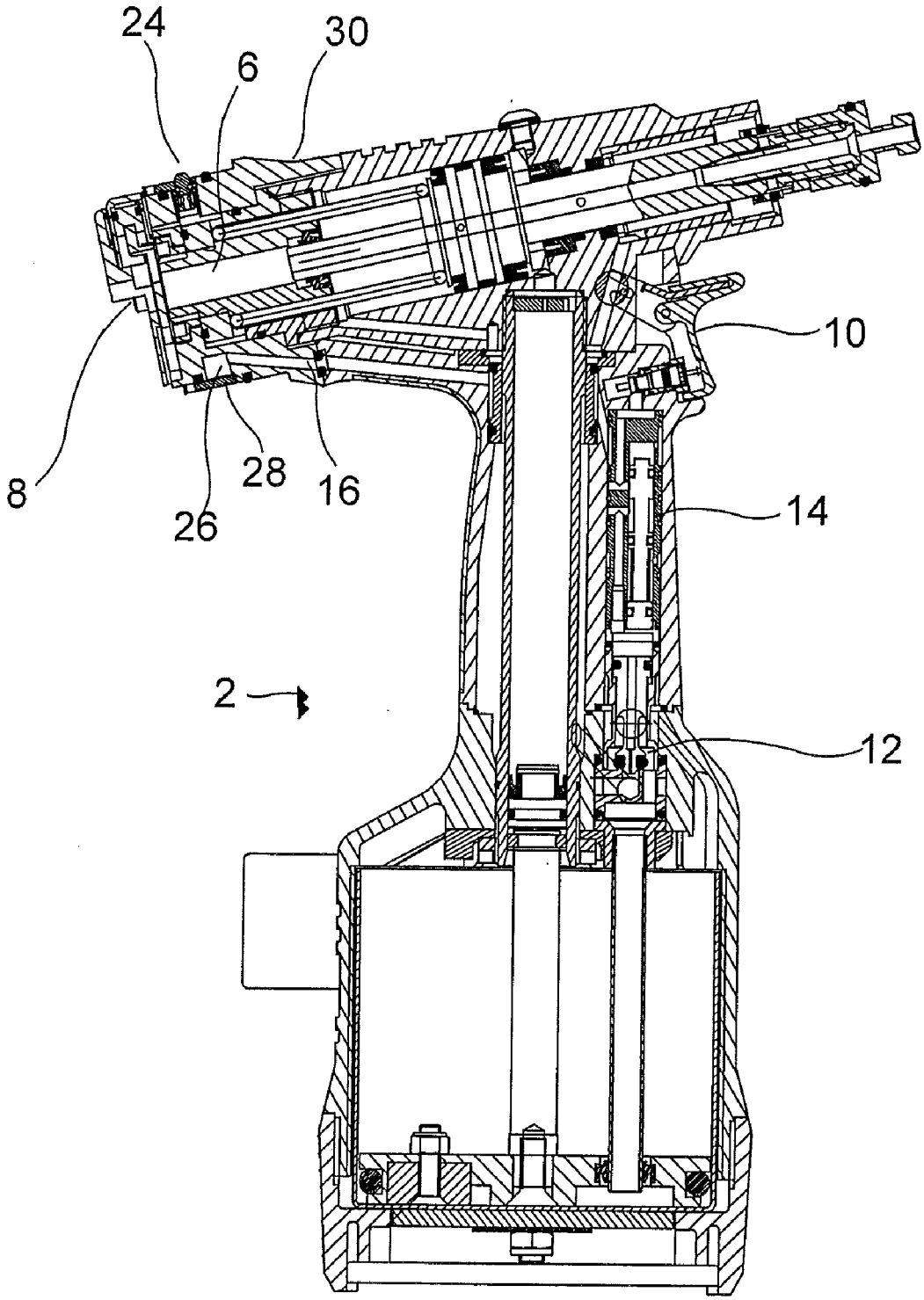
FIG. 8 is a cross-sectional view of the fastener installation tool of FIG. 7 with the collector bottle disconnected.
Figure 9:
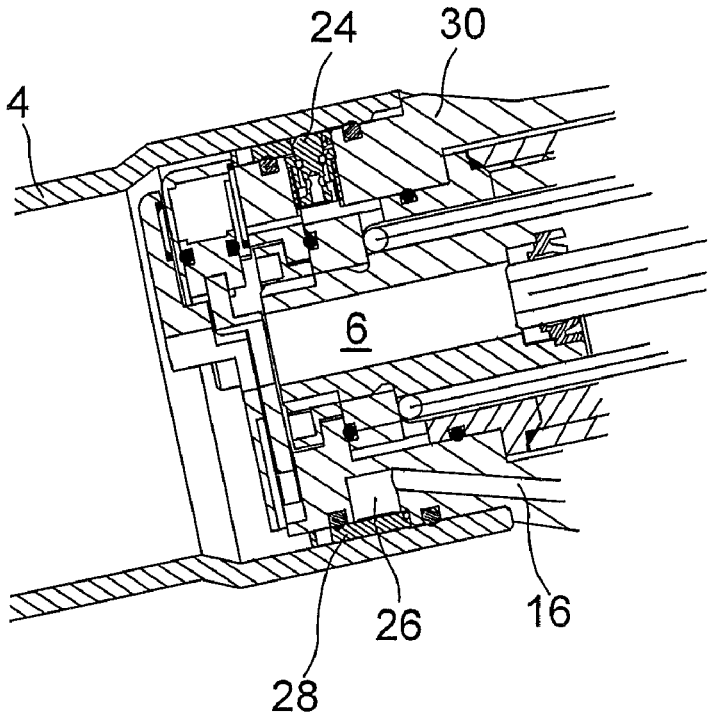
FIGS. 9 and 10 are partial cross-sectional views of the fastener installation tool of FIGS. 7 and 8 respectively.
Figure 10:
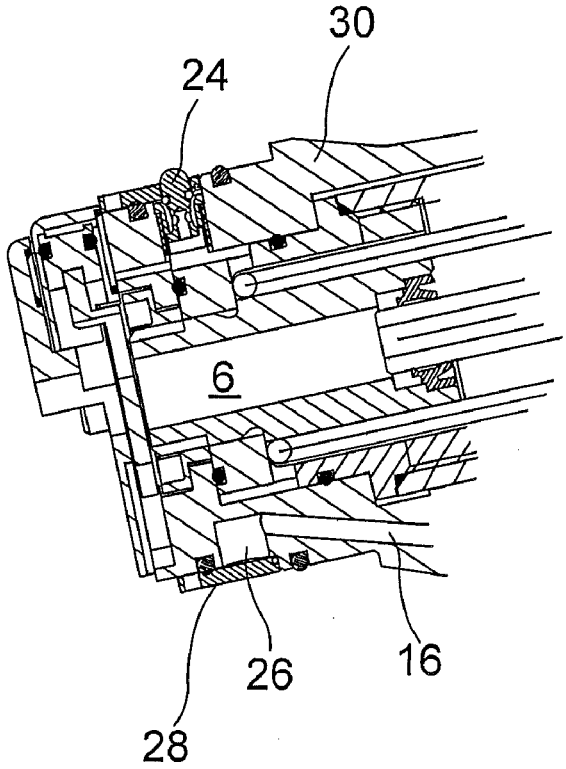

As illustrated in FIGS. 7 and 9, the tool 2 of this embodiment includes a sleeve 28 positioned between the adaptor 30 and the collector bottle 4. The sleeve 28 seals the aperture 18 through which compressed air would otherwise be vented. Between the tool 2 and sleeve 28 is a cavity 26.

When the collector bottle 4 is connected to the tool 2, a further, venting valve 24 is maintained in a closed state. When the venting valve 24 is closed, the positive pressure in the cavity 26 is allowed to vent to the atmosphere. In this state, a pressure signal is not sent to the disabling valve 14, and therefore the disabling valve 14 is open, allowing operation of the tool 2 to install a fastener.

On disconnection of the bottle, the venting valve 24 is caused to open. When the venting valve 24 is open, the cavity 26 is maintained in a pressurised state, thereby providing a positive pressure signal to the disabling valve 14. The disabling valve 14 therefore closes and prevents operation of the tool to install a fastener.

Figure 11:
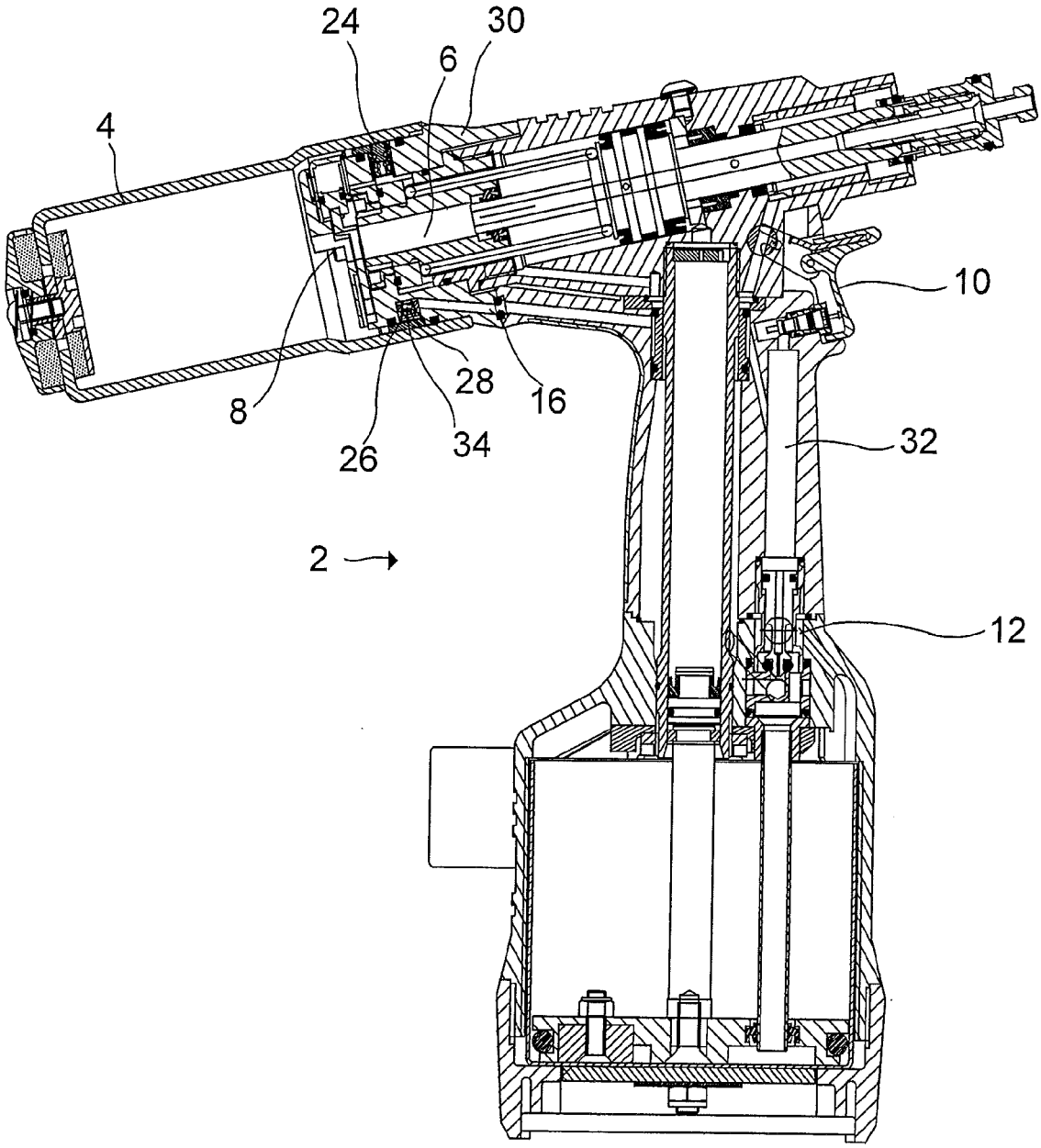
FIGS. 11 and 12 are cross-sectional views of a further alternative embodiment of a fastener installation tool in accordance with the present invention, with the collector bottle connected and disconnected respectively.
Figure 12:
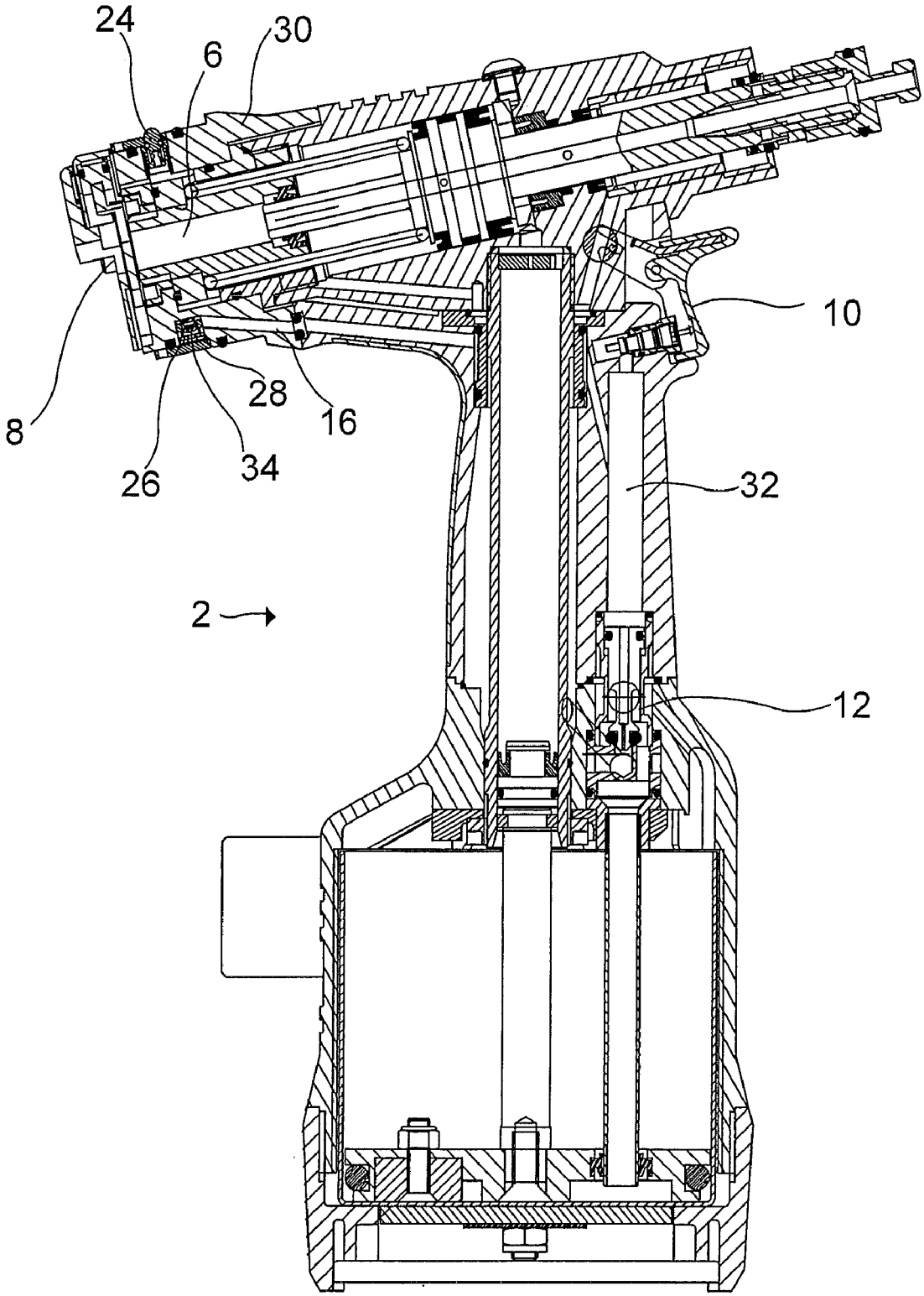

A third embodiment of the present invention is illustrated in FIGS. 11 and 12. The same numerals have been used as for the first embodiment where appropriate.

In the third embodiment, the disabling valve 14 is not present. The disabling means includes a chamber 32, which is provided in place of the valve 14 of the previous embodiments, and an internal valve 34, provided in the cavity 26, at the entrance to channel 16.

When the collector bottle 4 is connected to the tool 2, the venting valve 24 is maintained in a closed state. When the venting valve 24 is closed, the positive pressure in the cavity 26 is allowed to vent to the atmosphere. The internal valve 34 is maintained in a closed state, thereby preventing air escaping from the channel 16. In this state, no air is supplied to the chamber 32 via the channel 16. Air is fed to the chamber only by means of the main operating valve 12, and is prevented from escaping through cavity 26 by the internal valve 34. Thus air is supplied to the chamber 32 by the main operating valve 12 at a first rate, the first rate being sufficiently low that on depression of the tool trigger 10, air from the chamber 32 is evacuated, and the main trigger valve 12 is caused to actuate to cause installation of a fastener. Therefore when the collector bottle 4 is connected to the tool 2, the tool is enabled to install a fastener.

On disconnection of the collector bottle 4, the venting valve 24 and the internal valve 34 are caused to open. When the venting valve 24 is open, the cavity 26 is maintained in a pressurised state. As the internal valve 34 is open, air is supplied to the chamber 32 via channel 16. This air supply is in addition to the air supplied via the main operating valve 12, therefore resulting in a second rate of air supply to the chamber 32 which is higher than the first rate of air supply. When the tool trigger 10 is depressed, the rate of air supply is sufficiently high that the chamber 32 cannot be fully evacuated. Therefore the main operating valve 12 is disabled, and the tool 2 cannot be used to install a fastener when the collector bottle 4 is disconnected.

In a further alternative embodiment, the disabling means could be arranged to disable the vacuum extraction facility in addition to the tool trigger and main operating valve.

The disabling means may alternatively also be positioned elsewhere on the tool, for example between the main air inlet and the main operating valve.

The invention claimed is:

1. A fastener installation tool for installing fasteners of the type in which a part of the fastener is broken off during the installation process, which fastener installation tool is provided with a tool trigger, wherein depression of the tool trigger causes actuation of a main operating valve thereby to install a fastener, and collection means for collecting broken-off fastener parts during operation of the tool, the collection means being removably connected to the tool;

the tool being further provided with disabling means which are actuable to prevent operation of the main operating valve thereby to prevent use of the tool to install a fastener, the arrangement being such that when the collection means is disconnected from the tool, the disabling means are actuated.

2. A fastener installation tool as claimed in claim 1 wherein the disabling means when actuated prevent operation of the tool trigger.

3. A fastener installation tool as claimed in claim 2 wherein the tool includes a vacuum extraction facility for ejecting broken-off fastener parts into the collection means during operation of the tool, and wherein the disabling means when actuated prevents operation of the vacuum extraction facility.

4. A fastener installation tool as claimed in claim 3 wherein the valve is positioned between the main operating valve and an air inlet through which compressed air is supplied to the tool.

5. A fastener installation tool as claimed in claim 4 wherein the valve is maintained in a closed position by a positive pressure signal and wherein removal of the pressure signal causes the valve to change to an open position.

6. A fastener installation tool as claimed in claim 4 wherein the valve is maintained in a open position by a positive pressure signal and wherein removal of the pressure signal causes the valve to change to an closed position.

7. A fastener installation tool as claimed in claim 6 including a further valve, wherein when the collection means is disconnected from the tool, the further valve is open, and when the collection means is connected to the tool, the further valve is closed.

8. A fastener installation tool as claimed in claim 1 wherein the disabling means comprise a valve.

9. A fastener installation tool as claimed in claim 8, wherein the valve is connected in series with the tool trigger and the main operating valve.

10. A fastener installation tool as claimed in claim 9 wherein the valve is maintained in an open position by a positive pressure signal and wherein removal of the pressure signal causes the valve to change to a closed position.

11. A fastener installation tool as claimed in claim 9 wherein the valve is maintained in a closed position by a positive pressure signal and wherein removal of the pressure signal causes the valve to change to an open position.

12. A fastener installation tool as claimed in claim 11 including a Further valve, wherein when the collection means is disconnected from the tool, the further valve is open, and when the collection means is connected to the tool, the further valve is closed.

13. A fastener installation tool as claimed in claim 1 wherein the disabling means includes a chamber, wherein the chamber is supplied with air at a first rate when the collection means is connected to the tool, wherein depression of the tool trigger causes evacuation of the chamber thereby causing actuation of the main operating valve, and wherein the chamber is supplied with air at a second rate, the second rate being higher than the first, such that when the collection means is disconnected, the air supplied to the chamber is greater than that which can be evacuated on depression of the tool trigger, thereby preventing actuation of the main operating valve.

14. A fastener installation tool as claimed in claim 13 wherein the disabling means further includes at least two valves which are open when the collection means is disconnected from the tool, and closed when the collection means is connected to the tool.

15. A fastener installation tool as claimed in claim 13 wherein the chamber is positioned between the tool trigger and the main operating valve.

16. A fastener installation tool as claimed in claim 9 wherein the valve is maintained in a closed position by a positive pressure signal and wherein removal of the pressure signal causes the valve to change to an open position.

17. A fastener installation tool as claimed in claim 4 wherein the valve is maintained in a closed position by a positive pressure signal and wherein removal of the pressure signal causes the valve to change to an open position.

* * * * *